United States Patent [19]

Gefvert

[11] 4,265,569

[45] May 5, 1981

[54] ICE BARRIER FOR ISLANDS

[75] Inventor: Leland V. Gefvert, Anchorage, Ak.

[73] Assignee: Atlantic Richfield Company, Los Angeles, Calif.

[21] Appl. No.: 78,311

[22] Filed: Sep. 21, 1979

[51] Int. Cl.[3] ..... E02B 15/02

[52] U.S. Cl. ..... 405/217; 405/61

[58] Field of Search ..... 405/217, 61, 211–216; 114/40–43

[56] References Cited

U.S. PATENT DOCUMENTS

| | | | |
|---|---|---|---|
| 2,449,963 | 9/1948 | Ward | 405/61 |
| 3,461,577 | 8/1969 | Clark et al. | 114/40 UX |
| 3,572,273 | 3/1971 | Wood | 114/40 |
| 3,934,529 | 1/1976 | Gallagher | 114/40 |
| 3,952,527 | 4/1976 | Vinieratos et al. | 405/217 |
| 3,972,199 | 8/1976 | Hudson et al. | 405/217 |
| 4,102,144 | 7/1978 | Anders | 405/217 X |

*Primary Examiner*—Dennis L. Taylor

*Attorney, Agent, or Firm*—Roderick W. MacDonald

[57] ABSTRACT

An ice barrier module for disposition around at least part of the periphery of an island in an ice bearing body of water wherein the module is a closed, hollow triangular shaped body whose hypotenuse side faces the ice and whose first and second sides opposite the hypotenuse side rest on a bottom support and abut the island, respectively, the hypotenuse side having an upper and lower section, the upper section being at a steeper angle of inclination than the lower section, the hypotenuse side having means for heating same. An island in an ice bearing body of water which has around at least part of its periphery a plurality of the aforesaid ice barrier modules.

5 Claims, 3 Drawing Figures

ICE BARRIER FOR ISLANDS

BACKGROUND OF THE INVENTION

Sometimes it is useful to utilize existing islands or even make man-made islands in bodies of water which become iced over during winter months. A particular, but not limiting, example is the offshore drilling and/or production of gas and/or oil in polar regions such as the Arctic Ocean.

In such situations atmospheric and other environmental events can cause the ice layer formed on the surface of the body of water to move horizontally on such surface forming multiple layers of ice, pressure ridges, and the like, having a resultant thickness substantially greater than even the originally substantial ice thickness. When the single layer or multiple layers of ice is caused to move, the ice can pile up on islands which are in the direction of movement. This can cause substantial damage to the islands. Of course, in the situation of a man-made island the island may be made so large that ice movements will not substantially damage it, but this is extremely expensive even in situations where sufficient building material is available which often is not the case.

Accordingly, it is desirable to construct a man-made island or to reinforce a natural island in a manner such that it is economical to resist ice movement.

SUMMARY OF THE INVENTION

In accordance with this invention there is provided an ice barrier module which can be used alone or in combination of a plurality of such modules on the periphery of at least part of an island. The module will cause the break up of ice as it approaches the island thereby preventing the solid ice flow from impinging directly on the island with consequent high stresses because the ice is broken up before it reaches the island.

In accordance with one aspect of this invention there is provided an ice barrier module which is closed, hollow, and triangular shaped and wherein the hypotenuse side faces the ice and the first and second sides opposite the hypotenuse side rest on a support in the water body, e.g., the floor of the water body, and abut the island, respectively. The hypotenuse side is split into upper and lower sections with the upper section having a steeper angle of inclination than the lower section, and contains means for heating the hypotenuse side.

In accordance with another embodiment of this invention there is provided an island in an ice bearing body of water which island has around at least part of its periphery a plurality of ice barrier modules aforesaid.

Accordingly, it is an object of this invention to provide a new and improved apparatus for forming an ice barrier around the periphery of an island. It is another aspect to provide a new and improved ice resistant island which carries at least one ice barrier module in accordance with this invention on its periphery.

Other aspects, objects and advantages of this invention will be apparent to those skilled in the art from this disclosure and the appended claims.

DETAILED DESCRIPTION OF THE INVENTION

Figure 1:
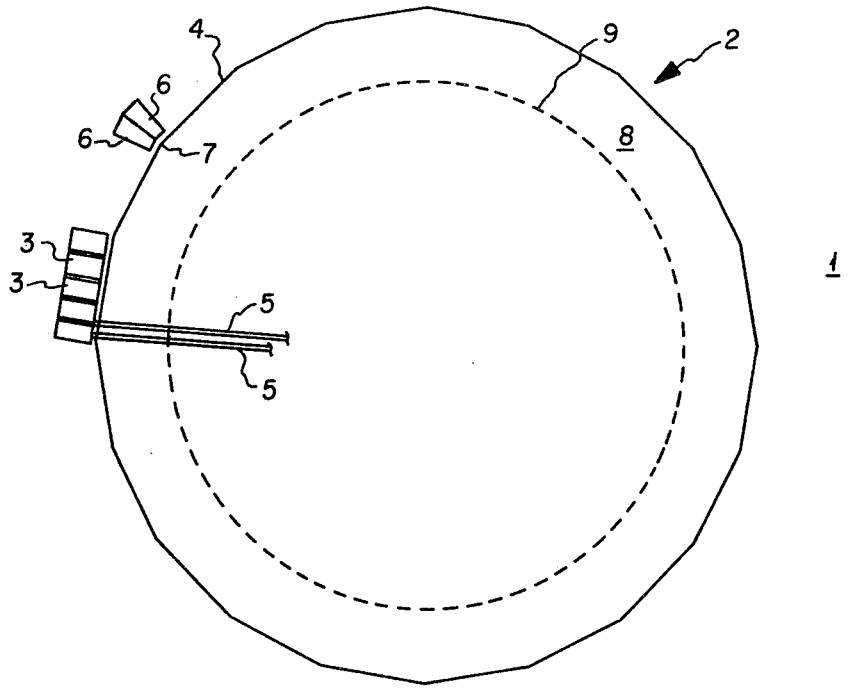
FIG. 1 shows the top view of an island having a plurality of ice barrier modules of this invention disposed on part of the periphery thereof.

FIG. 1 shows a body of water 1 in which is located an island 2, i.e., man-made or natural or natural and man reinforced, etc. In FIG. 1, for sake of example, island 2 is shown to be a man-made polygonal island with one of its flat sides having a plurality of ice barrier modules 3 abutting it.

As shown in FIG. 1, a plurality of modules 3 of this invention can be employed in side by side manner, contiguous or spaced apart as desired, and can be employed on part or all of the outer periphery 4 of island 2 depending upon where ice protection is needed or desired.

It can be seen that modules 3 are essentially rectangular in shape although other shapes such as truncated frustrums and the like can be employed within this invention. The modules can have pipes 5 fixed thereto for conducting heating fluid to and from one or more modules.

It can also be seen that the modules of this invention need not be limited to straight sides of an island but rather can be changed in shape, e.g., to a truncated frustrum, to adapt to apexes of a polygonal shaped island, e.g., modules 6 at apex 7, or a rounded periphery, or the like.

Since, in extreme situations, broken ice could be forced onto the island itself, it may be desirable to establish a buffer zone 8 between periphery 4 and dotted line 9 where no operations are to be carried out. Zone 8 is left open for receiving broken overflow ice.

Figure 2:
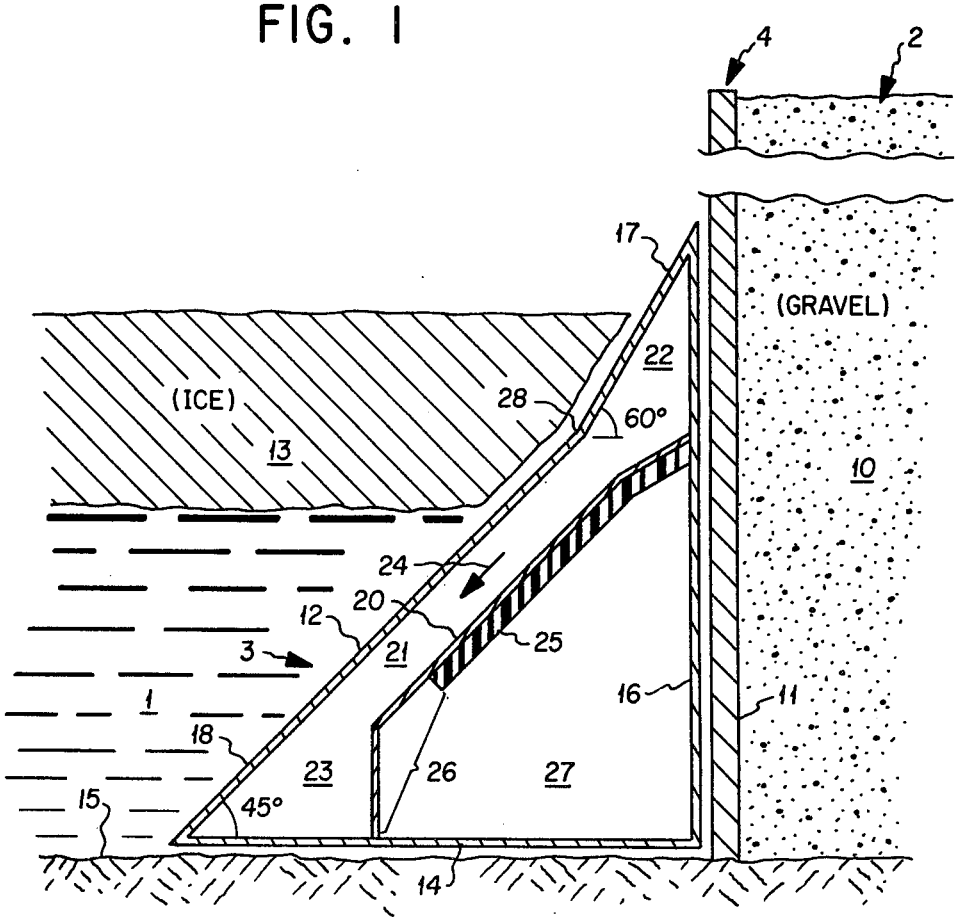
FIG. 2 is a cross-sectional vertical view of one of the ice barrier modules shown in FIG. 1.

FIG. 2 shows periphery 4 of island 2 to be composed of gravel 10 supported at periphery 4 by conventional sheet piling 11. FIG. 2 shows a cross-sectional elevation of one of modules 3 of FIG. 1 and reveals the module to be triangular in cross-section with its hypotenuse side 12 facing ice 13 while first side 14 opposite hypotenuse side 12 abuts the ocean floor 15 or a man prepared footing support such as a gravel pad (not shown) as required in the particular situation at hand.

The second side 16 opposite hypotenuse side 12 is an upstanding side which abuts the periphery of the island, piling 11 in the case of FIG. 2. It should be noted that although a space is shown between side 14 and floor 15 and between side 16 and piling 11 this is done for clarity sake only and would not normally be present in actual use.

Hypotenuse side 12 is divided into an upper section 17 and lower section 18 which have differing angles of inclination with respect to first side 14. For example, upper section 17 is shown to have a 60° angle of inclination with respect to side 14 whereas lower section 18 is shown to have a 45° angle of inclination with respect to side 14. This is important for the ice breaking feature of this invention. For example, ice sheet 13 impinging on hypotenuse side 12 is forced upwardly by lower section 18 and then even more upwardly by upper section 17, both causing vertical cracks in the ice thereby breaking it into smaller sections which are forced upwardly rather than horizontally directly into island 2 thereby translating the tremendous lateral force from ice pack 13 into upward movement and deflecting the force of ice pack 13 away from island 2.

In the embodiment of this invention shown in FIG. 2 an interior wall 20 spaced apart from hypotenuse side 12 is employed to provide conduit means 21 with upper and lower header spaces 22 and 23, respectively, for the flow of heating fluid therethrough to heat hypotenuse side 12 to prevent formation and/or clinging of ice to side 12. Ordinarily a heating fluid such as steam, hot water, or the like, would enter at manifold space 22, pass downwardly in the direction of arrow 24 and be recovered from the module by way of header space 23, utilizing pipes 5 as shown in FIG. 1.

Thermal insulation means 25 is employed over a portion of the hypotenuse side so as to provide maximum heating for side 12 in the vicinity of where the ice contacts side 12 and where side 12 is exposed to ambient air above the ice pack. However, below the ice pack where liquid water is present, i.e., area 26, thermal insulation 25 can be deliberately omitted to allow for some heat flow into interior 27 of module 3 to heat any freezable ballast liquid present in interior 27. The ballast liquid or other material used for ballast is employed in interior 27 to firmly ground the module on floor 15, and can be any weighting material, solid or liquid. It is preferably a convenient, inexpensive liquid such as water from water body 1, and therefore can be freezable. Of course, if the internal ballast material is not freezable the provision of uninsulated portion 26 can be eliminated. Such alterations are obvious to one skilled in the art, and because of such obviousness do not require further detailed discussion.

The change of slope at line 28 between upper section 17 and lower section 18 of hypotenuse side 12 can vary in its location depending on the particular situation in which module 3 is to be employed. For example, in normal situations in the Arctic Ocean slope change line 28 will be from about 3 to about 3½ feet below sea level. Encroaching ice pack 13 would then first contact heated lower section 18 with its first angle of inclination, be bent upwardly and pushed up on to heated upper section 17 with its greater angle of inclination whereby further upward tilting of the ice would occur until it was moving parallel to vertical piling 11 at which time it would become unstable in its ability to push directly against island 2.

In addition to, or in lieu of heating, either or both of the fluid being circulated through conduit means 21 and the ballast fluid in interior 27 can be treated with one or more antifreeze materials to lower their freezing point.

By way of further example, insulation 25 can extend down to approximately 10 feet from bottom side 14 so the last 10 feet of wall 20 is left uninsulated for transmission of some heat into the fluid in interior 27. The heating fluid entering manifold 22 can be at a temperature of about 35° F. and leave exit manifold 23 at a temperature of about 33° F. as an example of the type of low grade heating that can be employed in this invention. In order to minimize loss of heat to the atmosphere and thereby conserve heat, upper section 17 need protrude only 1 to 2 feet above the high tide line to carry out the intended performance of this invention.

Figure 3:
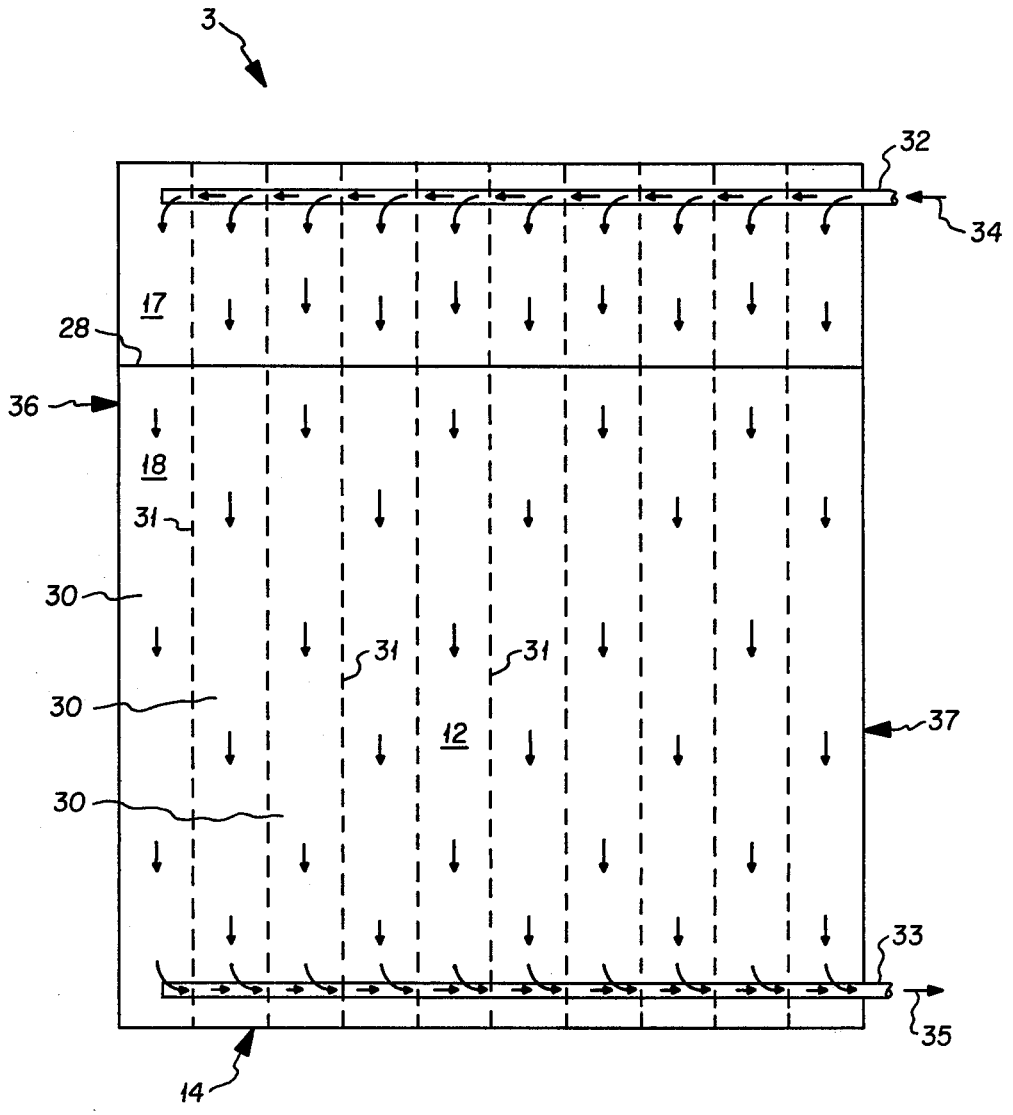
FIG. 3 is a front view of an ice barrier module in accordance with another embodiment of this invention.

FIG. 3 shows module 3 in modified form. FIG. 3 shows module 3 looking directly at hypotenuse side 12 as ice flow 13 of FIG. 2 would see module 3 as it approaches island 2. The modification in FIG. 3 is that heating means space 21 is divided into a plurality of individual conduit means 30 by way of dividers 31 with pipe manifold means 32 and 33 in upper and lower spaces 22 and 23 so that more uniform distribution of heating fluid from manifold 32 as shown by arrow 34 is achieved across hypotenuse side 12. The subdivided heating fluid is retrieved from each conduit means 30 by way of manifold 33 for return as shown by arrow 35 for reheating and reintroduction into manifold 32. Of course, other types of manifold and conduit means can be employed as will be obvious to one skilled in the art from the disclosure of this invention.

Sides 36 and 37 close off interior 27 and make module 3 a closed liquid-tight container.

Reasonable variations and modifications are possible within the scope of this disclosure without departing from the spirit and scope of this invention.

The embodiments of the invention in which an exclusive property or privilege is claimed are defined as follows:

1. An ice barrier module for disposition around at least part of the periphery of an island in an ice bearing body of water comprising a triangular shaped, closed, hollow body composed of an hypotenuse side and first and second sides opposite said hypotenuse side, said first side being adapted to rest on a support in said water body, said second side being adapted to abut said island, said hypotenuse side having upper and lower sections, said upper section having a steeper angle of inclination with respect to said first side than the angle of inclination of said lower section, said hypotenuse side carrying means for heating said upper and lower sections which comprises a plurality of heating fluid conduit means covering said hypotenuse side and manifold means near the top of said upper section and near the bottom of said lower section for circulating heating fluid through said conduit means, said upper section and a substantial portion of the upper part of said lower section are thermally insulated from the interior of said module, and the remaining lower part of said lower section is not thermally insulated thereby providing for heat flow from said conduit means into the interior of said module.

2. Apparatus according to claim 1 wherein said triangular shaped body is about a 45° right triangle wherein said upper section of said hypotenuse side is at about a 60° inclination with respect to said first side.

3. In an island in an ice bearing body of water said island having around at least part of its periphery at least one of the ice barrier modules of claim 1.

4. Apparatus according to claim 3 wherein said island is at least partly polygonal, its outer polygonal periphery is composed of sheet pilings, and said second side of said module abuts said sheet piling.

5. Apparatus according to claim 4 wherein said first side of said module rests on the floor of said body of water.

* * * * *